United States Patent [19]

Roman et al.

[11] Patent Number: 4,686,729

[45] Date of Patent: Aug. 18, 1987

[54] WASHING BRUSH WITH WATER SUPPLY AND ROTATING BRISTLES ESPECIALLY FOR MOTOR VEHICLES

[75] Inventors: Gianfranco Roman, Pasiano; Claudio Da Rold; Oliviano Spadotto, both of Pordenone, all of Italy

[73] Assignee: Claber S.p.A., Fiume Veneto, Italy

[21] Appl. No.: 823,292

[22] Filed: Jan. 28, 1986

[30] Foreign Application Priority Data

May 23, 1985 [IT] Italy ..... 21929/85[U]

[51] Int. Cl.[4] ..... A46B 13/06

[52] U.S. Cl. ..... 15/29

[58] Field of Search ..... 15/24, 29, 28, 97 R

[56] References Cited

U.S. PATENT DOCUMENTS 661,277 11/1900 Rix ..... 15/29

1,696,835 12/1928 Burnett ..... 15/29

2,682,675 7/1954 Prucha ..... 15/29

2,907,060 10/1959 Laitner ..... 15/29

3,909,875 10/1975 Rother et al. ..... 15/29

FOREIGN PATENT DOCUMENTS 197038 4/1958 Austria ..... 15/29

1021147 12/1957 Fed. Rep. of Germany ..... 15/29

345861 4/1931 United Kingdom ..... 15/29

*Primary Examiner*—Edward L. Roberts

*Attorney, Agent, or Firm*—Cushman, Darby & Cushman

[57] ABSTRACT

In a body in the form of a half-shell with a tubular handle, there is housed in a revolving manner a support plate for rotating bristles around which are placed fixed bristles. The support plate is surrounded by a ring gear which engages with a gear of smaller diameter arranged integrally and coaxially with a turbine impeller driven by water supplied through the handle.

1 Claim, 6 Drawing Figures

WASHING BRUSH WITH WATER SUPPLY AND ROTATING BRISTLES ESPECIALLY FOR MOTOR VEHICLES

BACKGROUND OF THE INVENTION

1. Field of the Invention

The present invention relates to a washing brush with water supply and rotating bristles especially for motor vehicles.

2. Description of the Related Art

Motor vehicle washing brushes are known which have an internal water supply capable of keeping wet both the bristles thereof and the surface to be washed.

In some brushes recently produced said water supply is also used to give a rotary movement to an assembly of bristles supported by a rotating plate born in a rotating manner by the body of the brush. For this puspose an impeller is provided which receives water under direct tangential pressure and with a turbine effect converts the hydraulic force received into mechanical energy used to cause rotation of the aforesaid rotating brush supporting plate.

In a known brush of the above type the impeller is mounted in an integral manner on and coaxially with the rotating brisle assembly around which is developed a ring of fixed bristels born by the body of the brush accomplished in the form of a half-shell.

This solution is not satisfactory because the impeller integral with the rotating bristle assembly cannot give it sufficient mechanical energy to prevent stopping of the bristles when they come in contact with the surface to be washed.

In another known brush the impeller is separate from the supporting plate of the rotating bristles and connected mechanically to it through a reducing gear made up of a small gear made integral and coaxial with the impeller and by a large gear mounted in an integral manner on the rotating pin of the bristle-holding plate. Fixed bristles are not provided around the rotating bristles.

In this case the reducing gear allows the impeller to transmit to the bristle-holding rotating plate a greater torque which allows the bristles to rotate even in contact with the surface to be washed.

Together with this advantage however there is the drawback of excessive height of the brush due to mounting of the larger gear of the reducer on a rotating pin of the rotating bristle-holder at a distance therefrom. Said excessive height prevents penetration of the brush in narrow spaces such as the space in which it frequently has to work. Construction thereof is also rather complex.

It should also be noted that the lack of fixed bristles reduces the washing capability of the brush and exposes the user to water sprays generated by the centrifugal effect of the rotating bristles. Said sprays also constitute wasted water which ceases to perform washing of the surface involved.

SUMMARY OF THE INVENTION

In view of this state of the art the object of the present invention is to provide a washing brush with a water supply and rotating bristles which would improve on presently known brushes and thus prove beneficial as to operating capability, as to size, and as to construction simplicity.

In accordance with the invention said object is achieved with a brush which comprises a fixed body in the form of a half-shell with a handle provided with a longitudinal channel for the water supply, a supporting plate for the rotating bristles born in a rotating manner by said fixed body, a turbine impeller designed to receive said water supply, and a motion reducing gear connecting dynamically said impeller with said rotating bristle assembly characterized in that said motion reducer is made up of a smaller gear made integral and coaxial with said impeller and of a larger gear formed of a ring gear accomplished integrally around said rotating bristle supporting plate.

The employment of a motion reducing gear thus formed clearly allows transmission to the rotating bristle assembly of a high torque capable of assuring rotation of the bristles even when said bristles are pressed against the surface to be washed. At the same time the construction thereof is extremely simple and the overall height thereof is very limited with a resulting limited height of the brush which can thus work even in narrow spaces.

Around the rotating bristle assembly, there is preferably provided a ring of fixed bristles born by a plate which closes the half-shell body of the brush which provides a containment effect of the water and improves the washing effect while preventing bothersome water sprays toward the operator. In addition the fixed bristle assembly which preferably extends further at the front and rear of the brush body makes possible a greater and more effective washing action to which is added manual rubbing of the surface to be washed.

The final result is a simpler, smaller and more effective rotating-bristle brush which is substantially more beneficial than those presently known.

BRIEF DESCRIPTION OF THE DRAWINGS

The characteristics of the present invention will be made clearer by the following detailed description of a preferred embodiment thereof illustrated as an example in the annexed drawings wherein.

DETAILED DESCRIPTION OF THE PREFERRED EMBODIMENT

Figure 1:
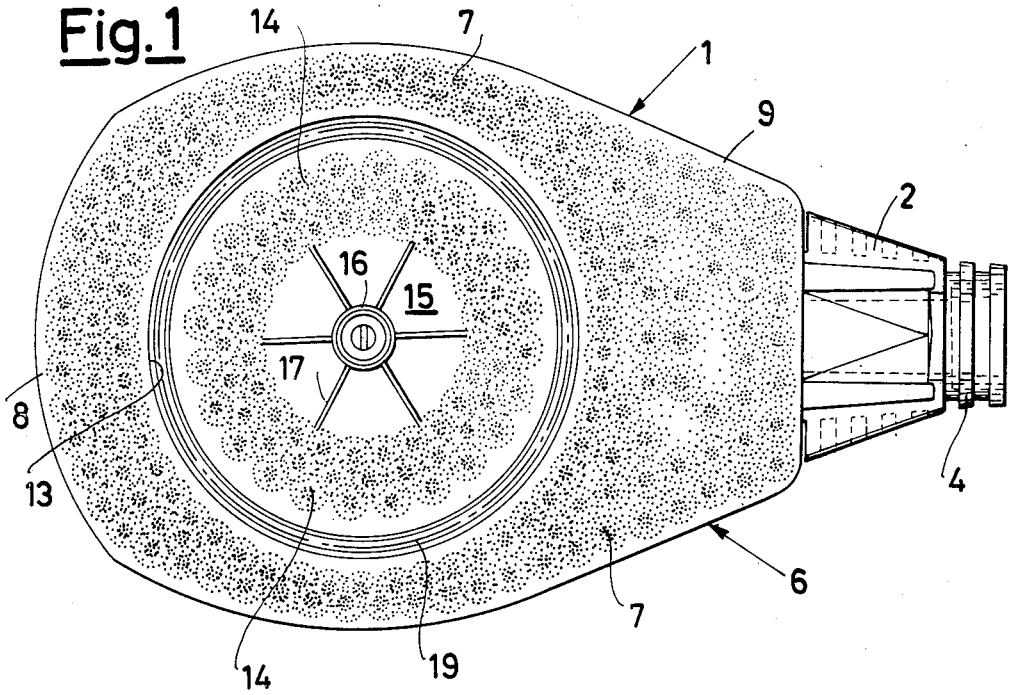
FIG. 1 shows a bottom view of the brush in accordance with the invention.
Figure 2:
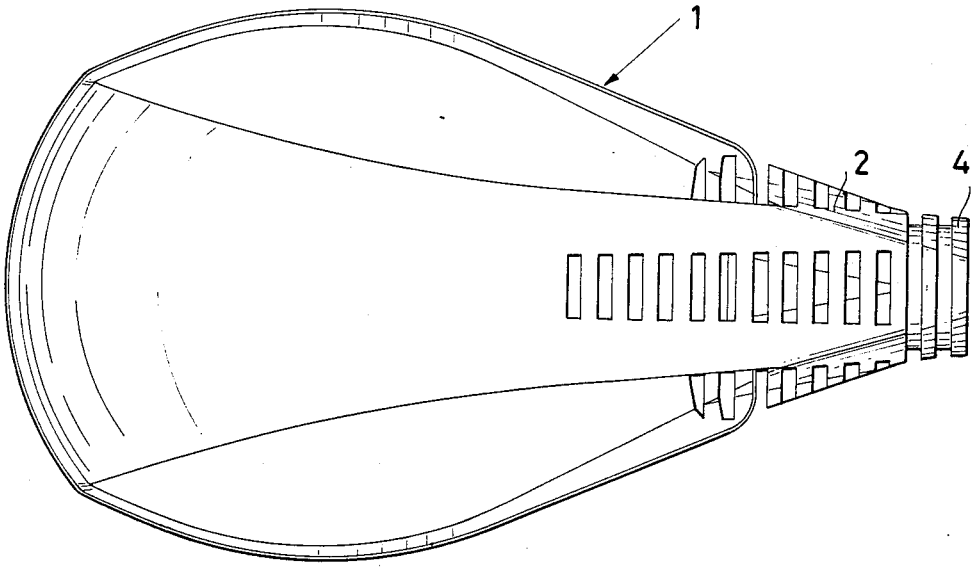
FIG. 2 shows a top view of said brush.
Figure 4:
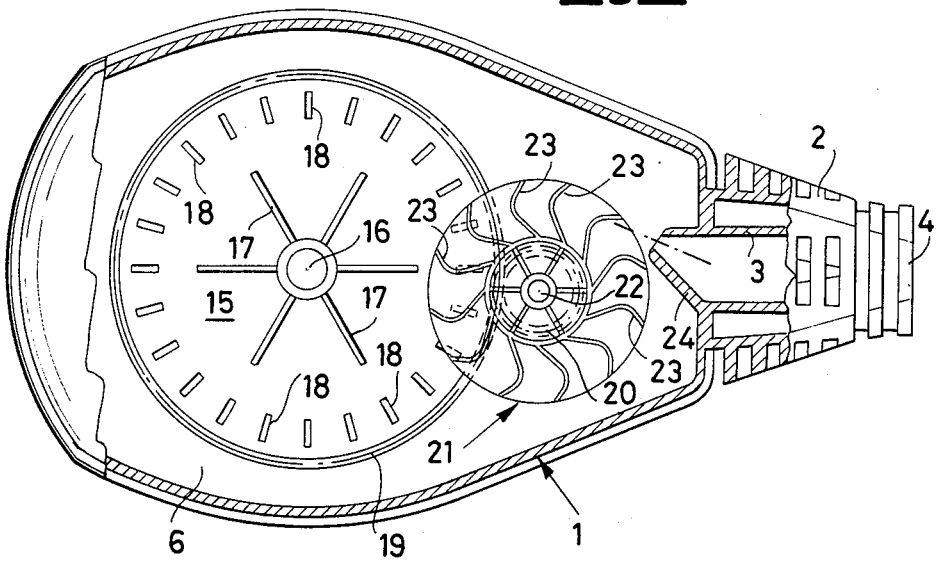
FIG. 4 shows a top view of said brush with part of the half-shell body removed to show the underlying structure.
Figure 5:
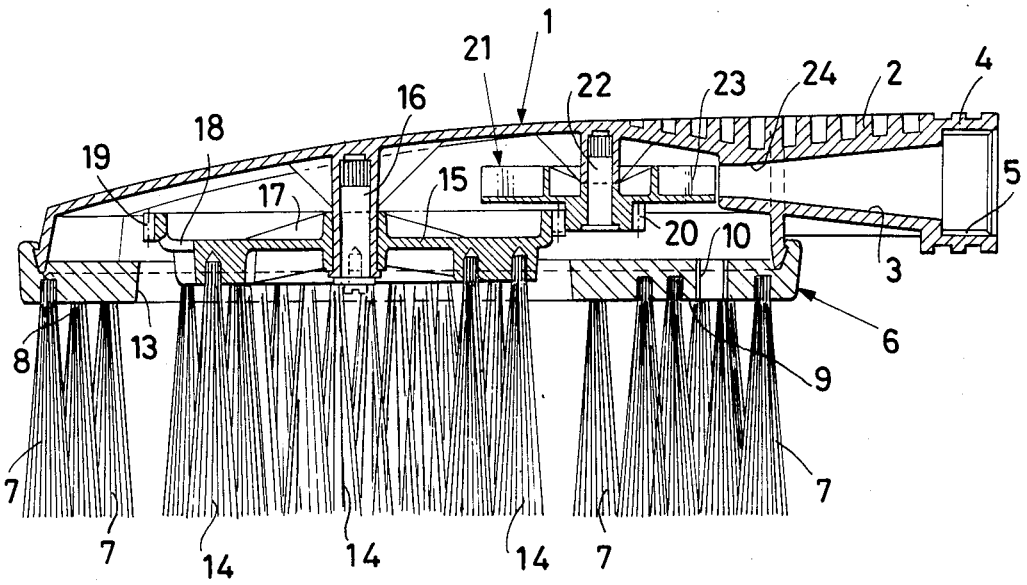
FIG. 5 shows said brush in a longitudinal section along a plane of cut V—V of FIG. 3.

The brush illustrated in FIG. 1 of the drawings comprises a main body 1 in half-shell form and preferably of plastic material and which has an integral handle 2 traversed by a longitudinal channel 3 FIGS. 4 and 5 designed for conveyance of the water supplied by the water system through a flexible hose and a rigid extention with a handle 2 appropriately coupled by a screw to said handle 2. For this purpose the outer end of the handle 2 is fitted with a union 4 having a female thread 5 (FIG. 5 only). An articulated joint may be provided in the handle 2 and in its abovementioned extension (not shown in the drawings) to allow inclination of the brush body with respect to the handle 2 or its extension.

Figure 3:
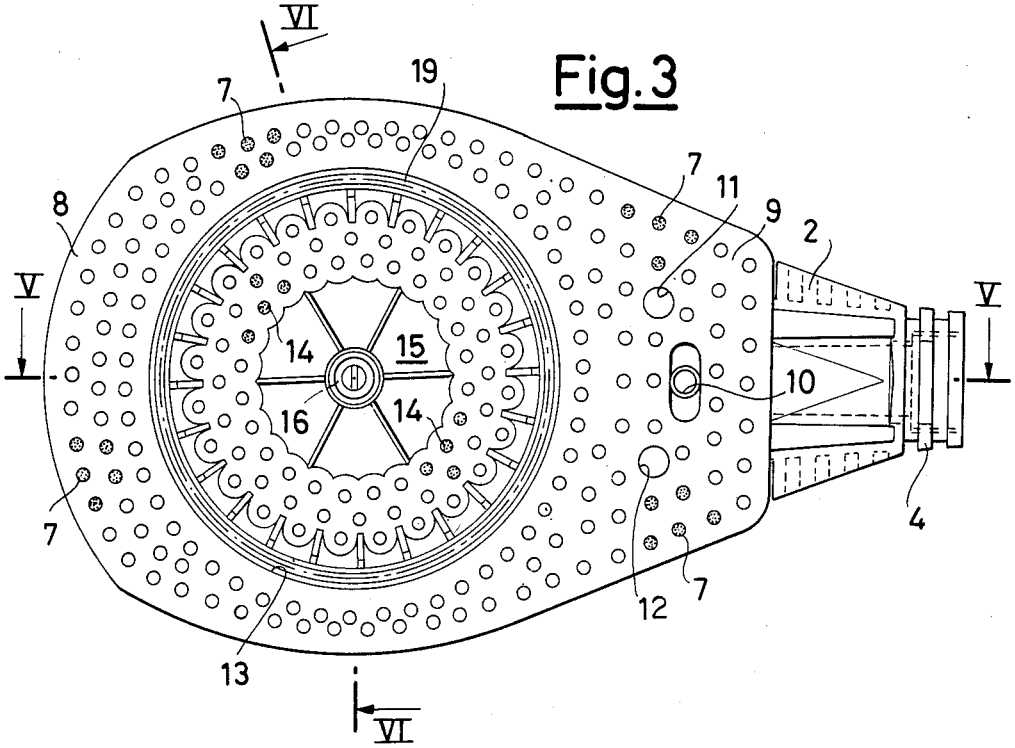
FIG. 3 shows a bottom view of said brush with the bristles removed to show the underlying structure.

The half-shell body 1 is partially closed along its perimeter by a flat plate 6 coupled by means of a spring clip to said body 1. The plate 6 bears an annular series of fixed bristles 7 which extend further at the front end 8 and especially at the rear end 9 of the plate 6 (FIGS. 1, 3 and 5). Three small holes, 10, 11, 12 (FIG. 3 only) traverse the rear end 9 of the plate 6 to provide communication between the internal cavity of the half-shell body 1 near the outlet of the channel 3 and the underlying bristle assembly.

Figure 6:
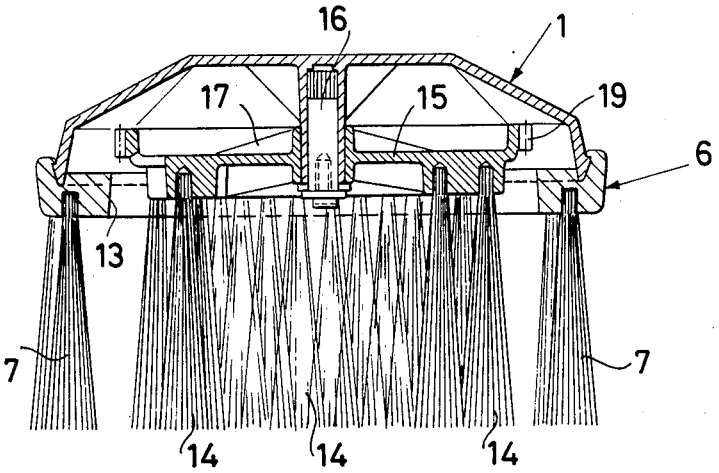
FIG. 6 shows said brush in a cross section along a plane of cut VI—VI of FIG. 3.

In its central part the plate 6 has a large round hole 13 (FIGS. 1, 3, 5 and 6) through which emerges a rotating bristle assembly 14 (FIGS. 1, 5, 6) fixed to a supporting plate 15 mounted in a revolving manner on a rotating pin 16 born by the fixed body 1 (FIGS. 5, 6). The plate 15 is fitted with reinforcing ribs 17 and openings or windows 18 for passage of the water destined to wet the rotating bristles 14.

Around the rotating bristle plate 15, there is provided in a single piece a ring gear 19 which comprises the major gear of a motion reducing gear unit operating in conjunction therewith and whose minor gear 20 is made integral and coaxial but on a different plane (FIG. 5) with a turbine impeller 21 mounted in a revolving manner on a rotating pin 22 born by the fixed body 1. The impeller 21 has an anular series of appropriately shaped turbine blades 23 which receive a stream of water under pressure from the channel 3 through an appropriate angular spout 24 and receive from said stream the energy necessary to bring about through the above-mentioned motion reducing gear 20, 19, rotation of the bristle plate 15 and hence of the central rotating bristles 14 with appropriate deflecting torque.

As a consequence when in use the central bristles 14 rotate when they are in contact with the surface to be washed and are bathed with water at the same time in such a manner as to exert on the surface to be washed a sprinkling such as to allow perfect and rapid washing of said surface. At the same time the peripheral fixed bristles 7 exert on the water involved with the rotating bristles 14 a beneficial containing action which improves the washing effect and prevents bothersome sprays toward the operator.

Both during and after washing the peripheral fixed bristles 7 may be used for finishing work, handling the brush in such a manner as to rub the bristles on the surface to be washed. For this purpose the amplest groups of bristles 7 at the two ends of the plate 6 improve the washing action and at the same time smooth the surface being washed.

We claim:

1. Washing brush, especially for a surface of a motor vehicle to be washed by an operator, comprising:

a main body in half-shell form carrying a plate on an underside of the main body and having a handle provided with a longitudinal channel means for providing a water supply therethrough, said plate having a round central hole therein, said main body having a front end and a rear end;

central support plate means, carried in a rotating manner by the main body, for rotating bristles thereon, said rotating bristles protruding through the round central hole in the plate on the underside of the main body;

turbine impeller means, arranged in the main body, for receiving the water supply from the longitudinal channel means;

a motion reducing gear unit, connected in a dynamic manner with the turbine impeller means and the central support plate means, said motion reducing gear unit including a minor gear arranged integrally and coaxially with the turbine impeller means and also including a major gear formed as a ring gear surrounding the central support plate means in contact with the minor gear;

an annular plurality of bristles fixed to the plate carried on the underside of the main body and placed around the ring gear surrounding the central support plate means carrying the rotating bristles, said annular plurality of bristles having zones of greater extension at the front end and the rear end of the main body; and a circumferential plurality of open window means, arranged in the central support plate means in a circle outside of the rotating bristles but inside the ring gear, for conveying the water supply from the turbine impeller means to the surface of the motor vehicle to be washed;

whereby the underside of the main body provides a containment effect for the water supply so that washing action is enhanced while bothersome water sprays toward the operator are prevented.

* * * * *